US007641408B2

(12) United States Patent
Niikura et al.

(10) Patent No.: US 7,641,408 B2
(45) Date of Patent: Jan. 5, 2010

(54) RECORDING APPARATUS

(75) Inventors: Takeji Niikura, Yokohama (JP); Haruo Uchida, Yokohama (JP); Nozomu Nishiberi, Yokohama (JP); Hiroyuki Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 135 days.

(21) Appl. No.: 11/188,637

(22) Filed: Jul. 26, 2005

(65) Prior Publication Data

US 2006/0024118 A1 Feb. 2, 2006

(30) Foreign Application Priority Data

Jul. 30, 2004 (JP) ..... 2004/223052

(51) Int. Cl.
*B41J 29/02* (2006.01)

(52) U.S. Cl. ..... 400/691; 347/108

(58) Field of Classification Search ..... 400/691; 347/108

See application file for complete search history.

(56) References Cited

U.S. PATENT DOCUMENTS

| | | | | |
|---|---|---|---|---|
| 2,483,843 | A * | 10/1949 | Prezioso | 400/691 |
| 5,154,411 | A | 10/1992 | Saito et al. | 271/289 |
| 5,177,547 | A | 1/1993 | Kanemitsu et al. | 355/321 |
| 5,191,382 | A | 3/1993 | Okamura et al. | 355/309 |
| 5,298,959 | A | 3/1994 | Saito et al. | 355/319 |
| 5,580,042 | A | 12/1996 | Taniguro et al. | 271/274 |
| 5,620,174 | A | 4/1997 | Taniguro et al. | 271/10.12 |
| 5,672,019 | A | 9/1997 | Hiramatsu et al. | 400/624 |
| 5,673,074 | A | 9/1997 | Miyauchi et al. | 347/104 |
| 5,725,319 | A | 3/1998 | Saito et al. | 400/629 |
| 5,738,452 | A | 4/1998 | Uchida | 400/624 |
| 5,738,453 | A | 4/1998 | Tsuburaya et al. | 400/624 |
| 5,742,318 | A | 4/1998 | Miyauchi et al. | 347/134 |
| 5,772,343 | A * | 6/1998 | Beretta et al. | 400/624 |

(Continued)

FOREIGN PATENT DOCUMENTS

CN 2187536 Y 1/1995

(Continued)

OTHER PUBLICATIONS

Machine translation of JP 2001122528 to Nakai et al. from Japanese Patent Office website.*

(Continued)

*Primary Examiner*—Daniel J Colilla
(74) *Attorney, Agent, or Firm*—Fitzpatrick, Cella, Harper & Scinto

(57) ABSTRACT

A recording device for effecting recording on a recording material by a recording head, said recording device including a recording unit including a reciprocally movable carriage for carrying the recording head, a platen for supporting a recording material at a position opposed to said carriage, and a feeding roller, disposed upstream of said platen, for feeding the recording material, a recording chassis supporting said carriage, said platen and said feeding roller, and a sheet feeding unit including a feeding path for feeding the recording material to said feeding roller from a plurality of feeding portions, and a side chassis supporting said feeding path at both lateral sides with respect to a moving direction of the recording material, whereby said recording chassis of said recording unit and said side chassis of said sheet feeding unit are fixed to each other.

7 Claims, 8 Drawing Sheets

U.S. PATENT DOCUMENTS

| | | | | |
|---|---|---|---|---|
| 5,800,083 | A * | 9/1998 | Gaarder et al. | 400/185 |
| 5,899,613 | A | 5/1999 | Koike et al. | 399/384 |
| 5,902,058 | A | 5/1999 | Koike et al. | 400/578 |
| 5,918,873 | A | 7/1999 | Saito et al. | 271/10.11 |
| 5,984,300 | A | 11/1999 | Nishiberi | 271/171 |
| 6,015,202 | A | 1/2000 | Hiramatsu et al. | 347/32 |
| 6,129,461 | A * | 10/2000 | Nakai | 400/59 |
| 6,168,270 | B1 | 1/2001 | Saikawa et al. | 347/104 |
| 6,305,682 | B1 | 10/2001 | Saito et al. | 271/10.11 |
| 6,379,064 | B1 * | 4/2002 | Giles et al. | 400/691 |
| 6,416,050 | B1 | 7/2002 | Niikura | 271/127 |
| 6,634,819 | B2 | 10/2003 | Uchida | 400/691 |
| 6,834,177 | B2 | 12/2004 | Saito et al. | 399/313 |
| 6,834,950 | B2 * | 12/2004 | Hugle | 347/108 |
| 6,939,064 | B2 | 9/2005 | Kawaguchi et al. | 400/283 |
| 7,046,380 | B2 | 5/2006 | Nishiberi et al. | 358/1.12 |
| 7,114,805 | B2 * | 10/2006 | Niikura | 347/108 |
| 2002/0085239 | A1 * | 7/2002 | Niikura | 358/400 |
| 2004/0027441 | A1 * | 2/2004 | Niikura et al. | 347/107 |
| 2004/0033084 | A1 | 2/2004 | Akizuki et al. | 399/69 |
| 2004/0041331 | A1 | 3/2004 | Sonoda et al. | 271/121 |
| 2004/0086310 | A1 * | 5/2004 | Eskey | 399/401 |
| 2004/0155923 | A1 * | 8/2004 | Ikeda et al. | 347/37 |
| 2005/0012800 | A1 * | 1/2005 | Ohashi | 347/104 |
| 2005/0270353 | A1 | 12/2005 | Nishiberi et al. | 347/104 |
| 2006/0023050 | A1 | 2/2006 | Nishiberi et al. | 347/104 |
| 2006/0024118 | A1 | 2/2006 | Niikura et al. | 400/691 |
| 2006/0164491 | A1 * | 7/2006 | Sakuma et al. | 347/104 |

FOREIGN PATENT DOCUMENTS

| | | | |
|---|---|---|---|
| CN | 1135170 | | 11/1996 |
| JP | 2001122528 | A * | 5/2001 |
| JP | 2001199599 | A * | 7/2001 |
| JP | 2002-192788 | | 7/2002 |
| JP | 2002370419 | A * | 12/2002 |
| JP | 2004102165 | A * | 4/2004 |
| WO | WO 95/13788 | | 5/1995 |

OTHER PUBLICATIONS

Chinese Office Action (English Translation) issued by The Patent Office of The People's Republic of China, in Chinese Application No. 2005100876863.

* cited by examiner

RECORDING APPARATUS

FIELD OF THE INVENTION AND RELATED ART

The present invention relates to a recording apparatus which employs one or more recording heads mounted on a carriage, to form an image on recording medium while the recording medium is conveyed along the top surface of a platen.

Recording apparatuses having the function of a printer, a copying apparatus, a facsimileing machine, and/or the like, recording apparatuses used as the outputting device for a multi-functional electronic device or workstation, which comprises a computer and/or wordprocessor, etc., are structured to form an image on recording media, such as a piece of paper or plastic sheet, according to image formation data. As the recording method used by a recording apparatus, there are various methods, for example, the ink jet recording method, the thermal transfer recording method, the laser beam recording method, the wire-dot recording method, etc. Among various recording apparatuses employing one of these recording methods, a recording apparatus which records an image on recording medium by ejecting ink onto the recording medium from the ejection orifices of the recording head is advantageous over the others in that it is easy to reduce in size; it can be easily modified for forming a multicolor image; it is lower in noise and operational cost; etc.

The above described recording apparatuses can be roughly divided into two types: the serial type and line type. In the case of the recording apparatuses of the serial type, recording is made by moving a recording head relative to recording medium (scanning recording medium in primary scan direction), and in the case of the recording apparatuses of the line type, recording is made by moving only recording medium (moving recording medium in secondary scan direction). As for the feeding of recording medium into a recording apparatus, most of the abovementioned recording apparatuses are structured so that sheets of recording mediums are fed one by one into the apparatus main assembly from the sheet feeding portion, which is at the top rear portion of the main assembly, and in which multiple sheets of recording medium are stored slightly tilted.

However, recording apparatuses equipped with a sheet feeding portion for feeding sheets of recording medium from a recording medium storage tray portion, in particular, recording apparatuses equipped with multiple recording medium storage portions, and provided with multiple recording medium conveyance routes for making it possible to feed sheets of recording medium from the multiple recording medium storage portions, suffer from the following problems. That is, first, the recording apparatuses have been likely to be large. Second, they have been difficult to assemble. Third, it has been difficult to improve in shock-resistance such recording apparatuses as those described above, in spite of the increase in the weight of the main assembly of the recording apparatus. Fourth, they are difficult to improve in recording medium conveyance performance.

SUMMARY OF THE INVENTION

The primary object of the present invention is to provide a recording apparatus which is equipped with a sheet feeding portion for feeding recording medium into the main assembly of the recording apparatus from the recording medium storage portion of the recording apparatus, and which is characterised in that it is smaller in size, easier to assemble, more shock-resistant, and more stable in recording medium conveyance performance, than a recording apparatus in accordance with the prior arts.

According to an aspect of the present invention, there is provided a recording device for effecting recording on a recording material by a recording head, said recording device comprising a recording unit including a reciprocally movable carriage for carrying the recording head, a platen for supporting a recording material at a position opposed to said carriage, a feeding roller, disposed upstream of said platen, for feeding the recording material, and a recording chassis supporting said carriage, said platen and said feeding roller; and a sheet feeding unit including a feeding path for feeding the recording material to said feeding roller from a plurality of feeding portions, and a side chassis supporting said feeding path at both lateral sides with respect to a moving direction of the recording material, whereby said recording chassis of said recording unit and said side chassis of said sheet feeding unit are fixed to each other.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Figure 1:
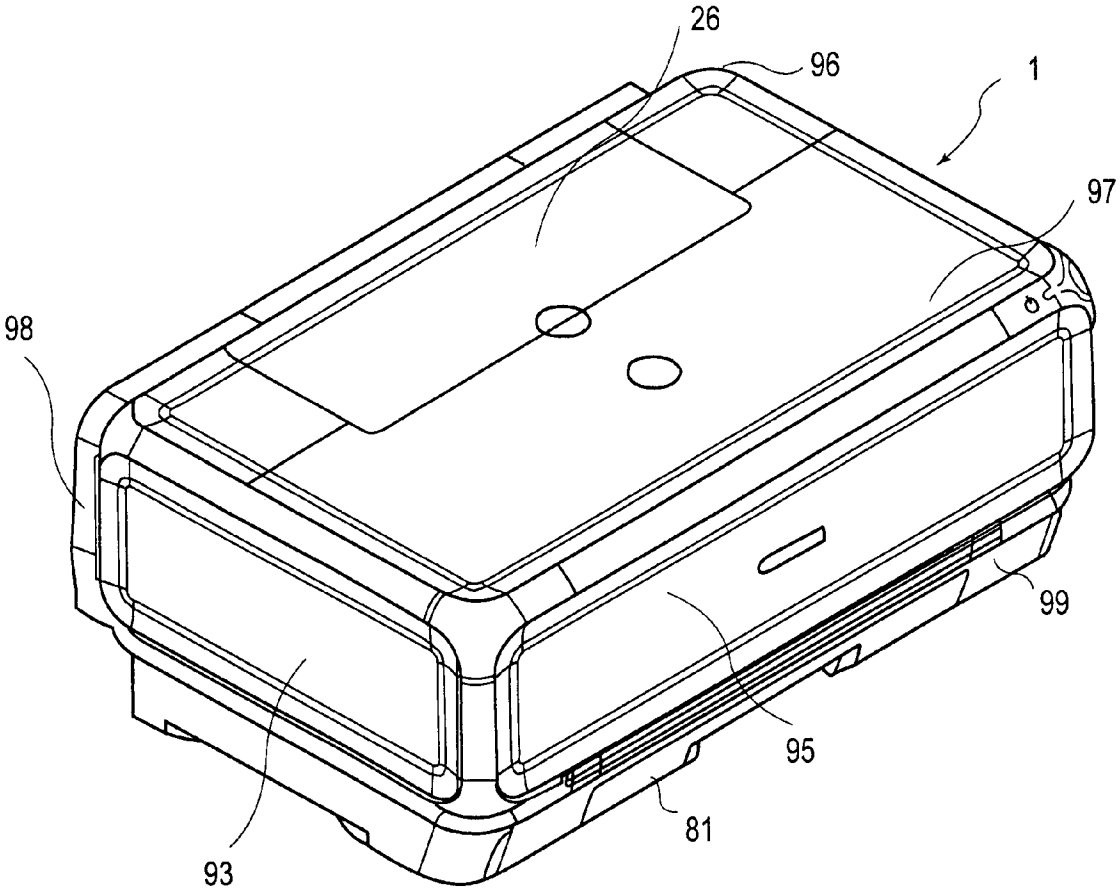
FIG. 1 is an external perspective view of a typical recording apparatus in accordance with the present invention.
Figure 2:
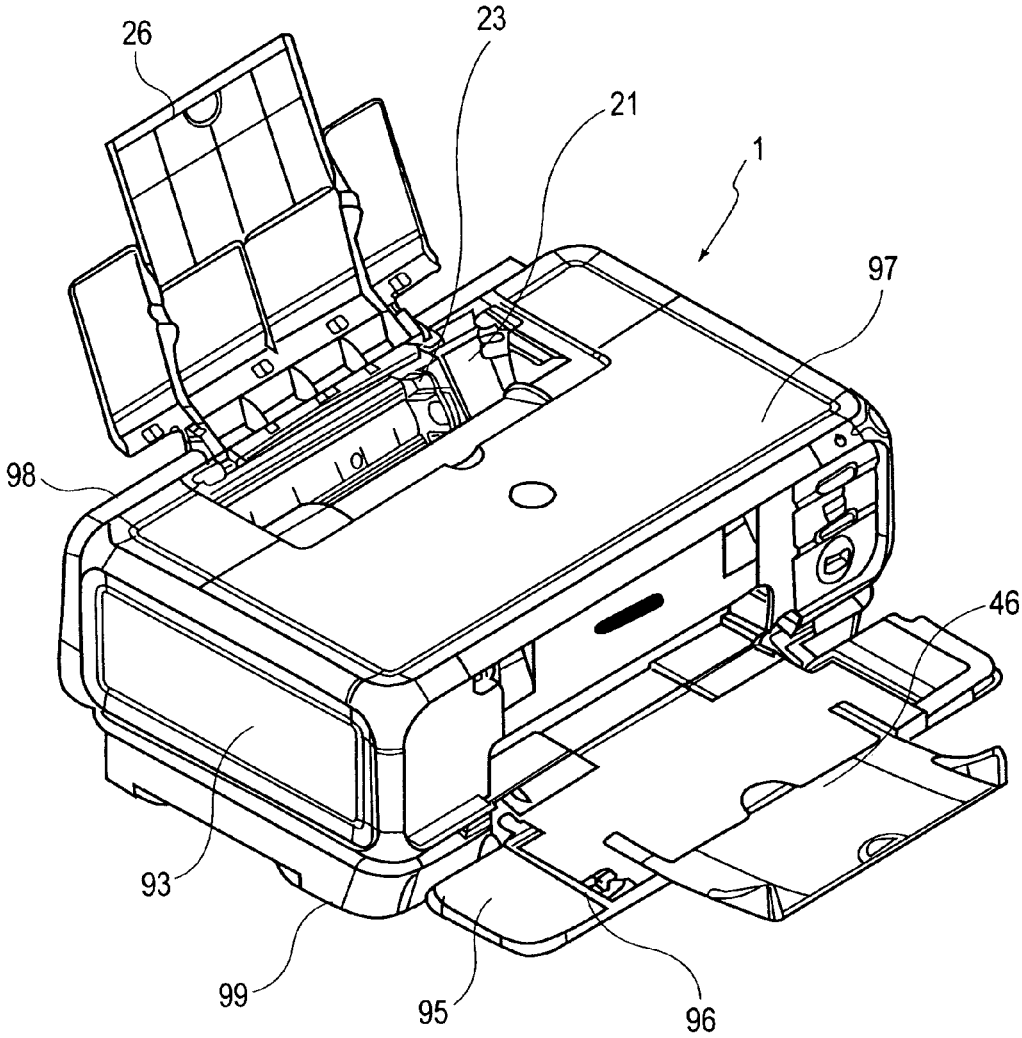
FIG. 2 is an external perspective view of the same recording apparatus as the one show in FIG. 1, which has been set up for usage.
Figure 3:
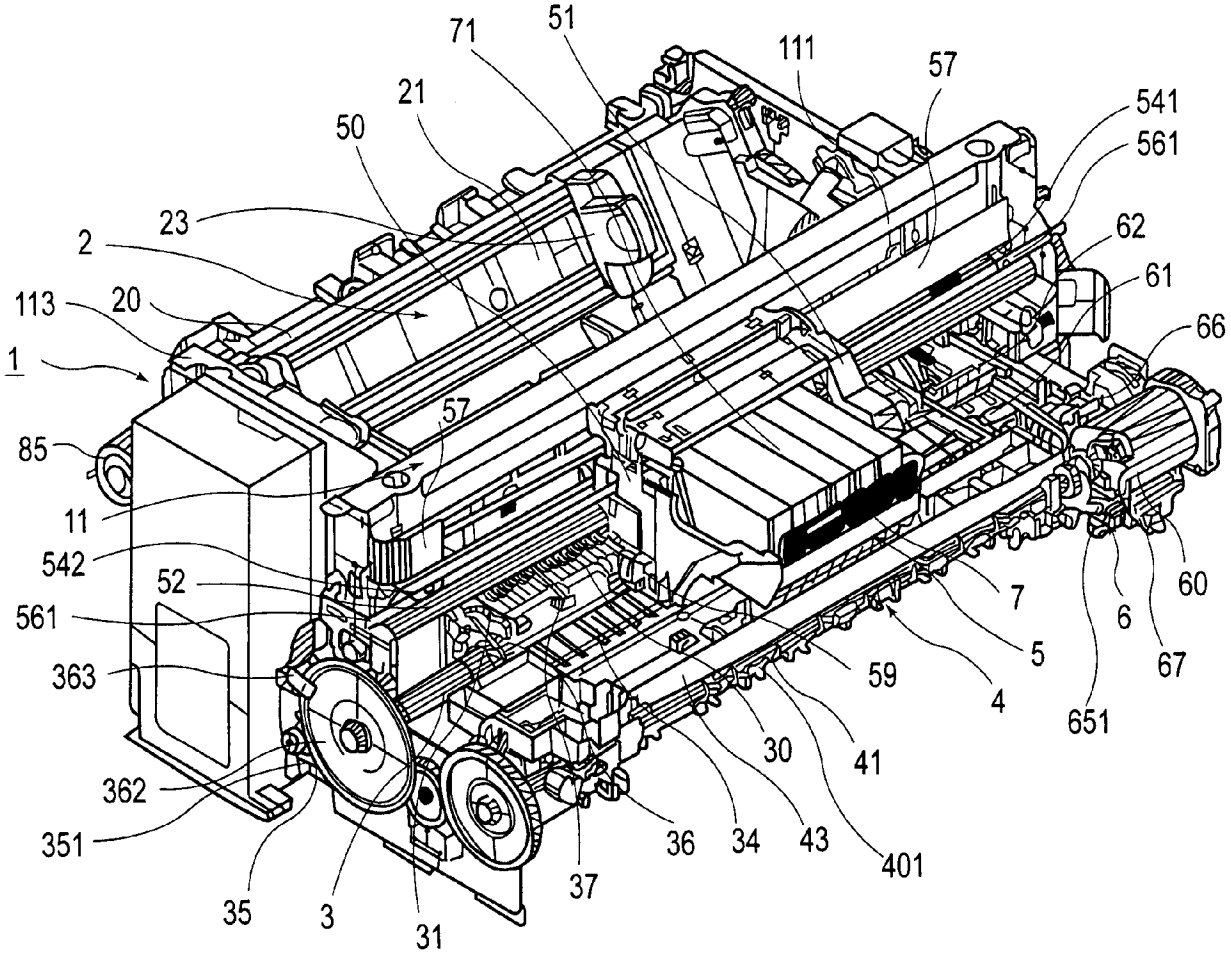
FIG. 3 is a perspective view of the same recording apparatus as the one shown in FIG. 1, the cover of which has been removed, as seen from the left front side of the apparatus, showing the internal structure thereof.
Figure 4:
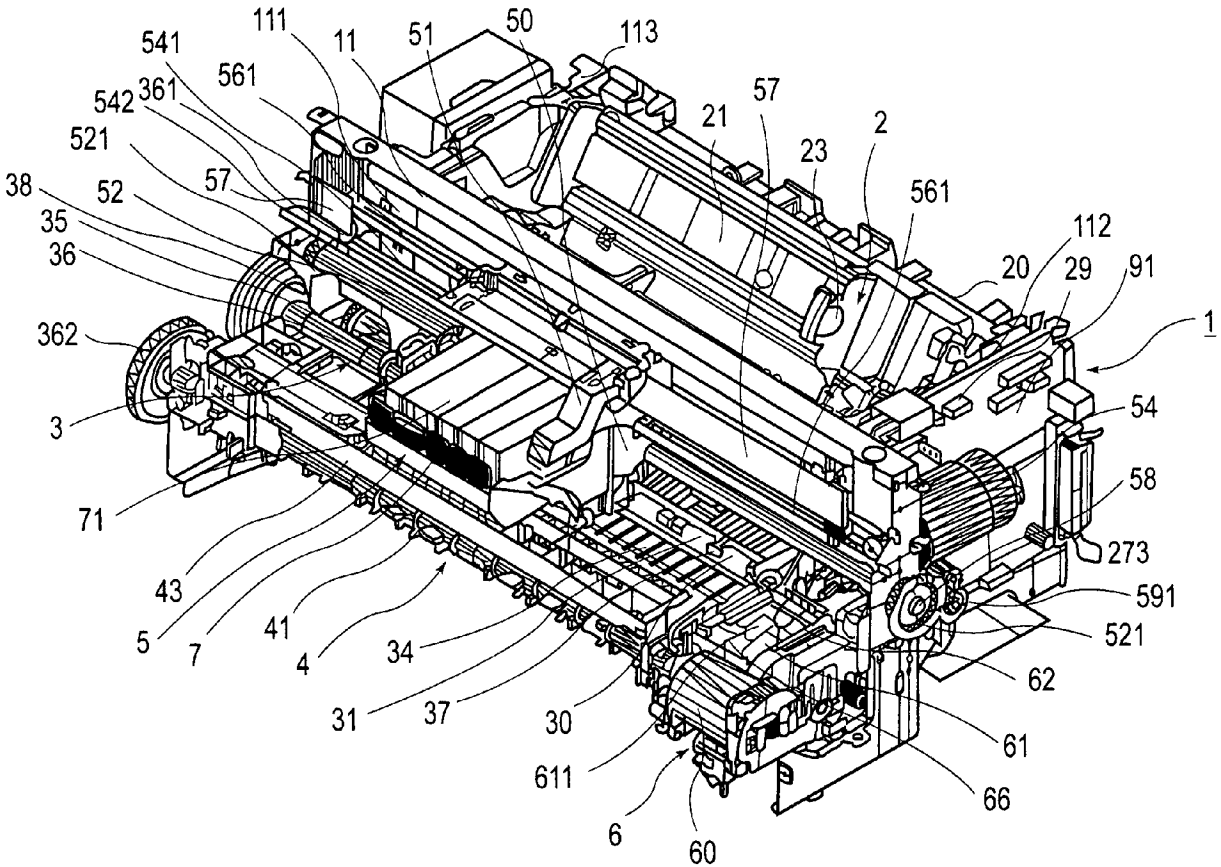
FIG. 4 is a perspective view of the same recording apparatus as the one shown in FIG. 1, the cover of which has been removed, as seen from the right front side of the apparatus, showing the internal structure thereof.
Figure 5:
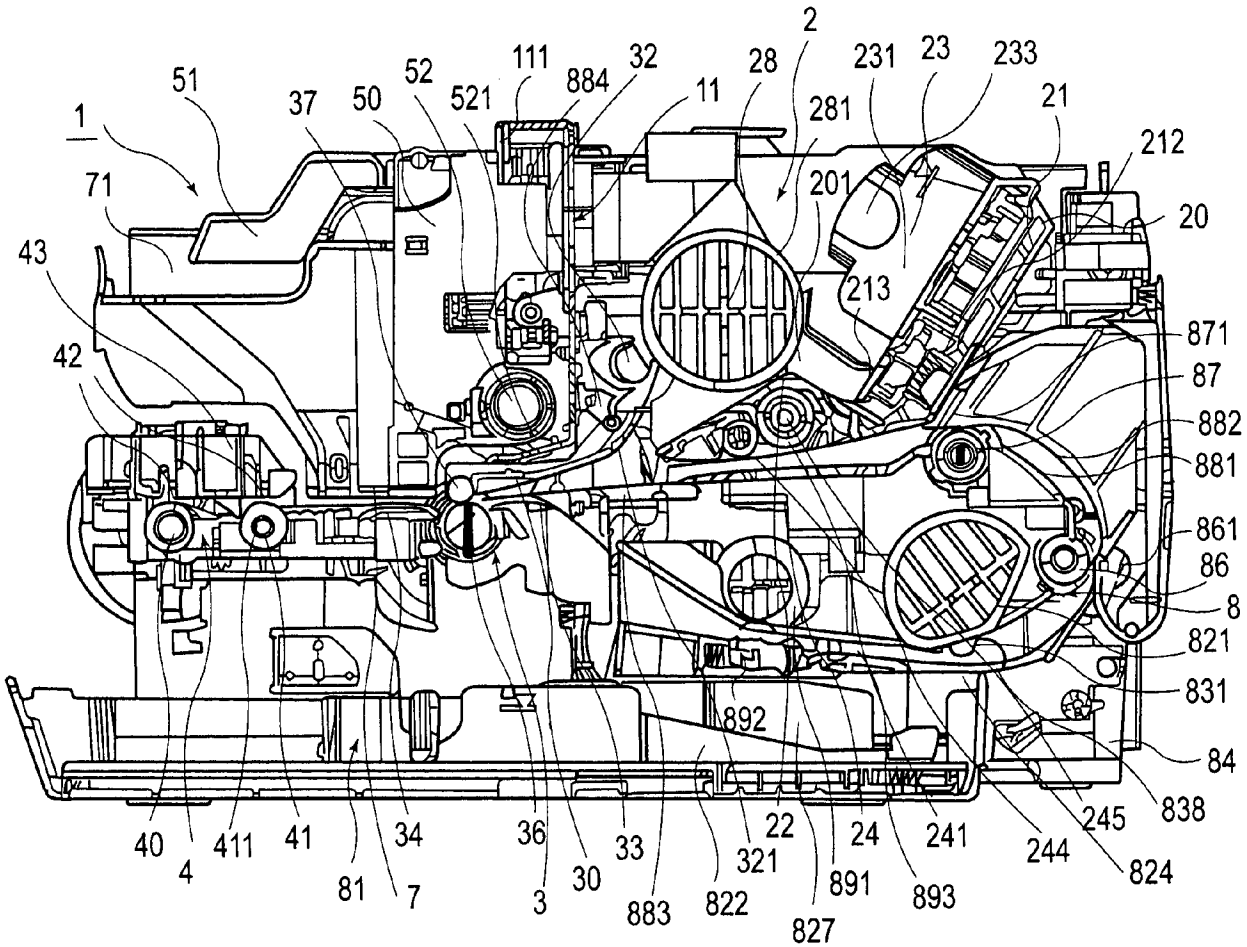
FIG. 5 is a sectional view of the same recording apparatus as the one shown in FIG. 1, showing the general internal structure thereof.

Hereinafter, one of the preferred embodiments of the present invention will be described in detail with reference to the appended drawings. Throughout the following description of the preferred embodiment, if a component in one of the drawings is identical in referential symbol to a component in another drawing, the two components are virtually identical in function. FIG. 1 is an external perspective view of the recording apparatus in this embodiment of the present invention, and FIG. 2 is an external view of the same recording apparatus as the one shown in FIG. 1, which has been set up for usage. FIG. 3 is a perspective view of the recording apparatus in accordance with the present invention, the cover of which has been removed, as seen from the left front side, showing the general structure thereof, and FIG. 4 is a perspective view of the same recording apparatus as the one shown in FIG. 3, the cover of which has been removed, as seen from the right front side, showing the general structure thereof. FIG. 5 is a sectional view of the recording apparatus in accordance with the present invention, showing the general internal structure thereof.

This embodiment will be described with reference to a case in which the recording apparatus is an ink jet recording apparatus which records an image on recording medium by ejecting ink from its recording head onto the recording medium. In FIGS. 3-5, the recording apparatus 1 is made up of a sheet feeding portion 2, a sheet conveying portion 3, a sheet discharging portion 4, a carriage portion 5, a recovery mechanism portion 6 (cleaning portion), a recording head 7, a U-turn sheet feeding portion 8 inclusive of the two-sided printing path, and an external shell 9. Next, these portions and mechanisms will be described in the logical order.

[Sheet Feeding Portion]

The sheet feeding portion 2 for feeding recording medium into the main assembly of the recording apparatus 1 from the recording medium storage portion is made up of a pressure plate 21 against which one or more sheets P of recording medium are placed; a sheet feeder roller 28 (which hereinafter will be simply referred to as feed roller) which feeds the sheet P; a separation roller 241 which separates the sheets P; a return lever 22 for returning the sheets P to the standby location; and a base 20 to which the preceding portions, components, etc., are attached. A sheet feeder tray 26 for holding the mounted sheets P is attached to either the base 20 or the external shell 9. The sheet feeder tray 26 of the sheet storage portion is of the multistage type, and is to be pulled out for usage. The feed roller 28 is in the form of a rod and is roughly D-shaped in cross section. It is provided with a sheet feeder rubber by which a sheet of recording medium is conveyed. The sheet feeder rubber is positioned close to the sheet positioning reference. The feed roller 28 is driven by an unshown motor 27 with which the sheet feeding portion 2 is provided, and which is shared by the recovery mechanism portion 6. From this motor 27 (which hereinafter will be referred to as AP motor), the force for driving the feed roller 28 is transmitted to the feed roller 28 through a driving force transmission gear 271 (unshown), a planetary gear 272 (unshown), etc.

The pressure plate 21 is provided with a movable side guide 23 for accurately positioning the sheets P. The pressure plate 21 is pivotable about its pivotal axle, which is a part of the base 20. The pressure plate 21 is kept pressured against the feeder roller 28 by leaf springs 212. To the portion of the surface of the pressure plate 21, which directly faces the feed roller 28, a separation sheet 213 formed of artificial leather or the like substance, which is large in coefficient of friction, is attached to prevent one or more of the sheets P below the topmost sheet from being fed together with the topmost sheet P. The pressure plate 21 can be placed against the feed roller 28 or moved away therefrom by a pressure plate cam 214 (unshown). The sheet feeding portion 2 is also provided with a separation roller holder 24, which holds the separation roller 241 for separating one by one the sheets P, and is attached to the base 20, being enabled to pivot about the rotational axis. The separation roller 241 is kept pressed against the feed roller 28 by separation roller springs 241 (unshown).

The separation roller 241 is fitted with a spring clutch 243, which allows the separation roller 241 to rotate only when the amount of load to which the separation roller 241 is subjected is greater than a predetermined value. The separation roller 241 and the components related thereto are structured so that the separation roller 241 is pressed against, or separated from, the feed roller 28 by a separation roller release shaft 244 and a control cam 25 (unshown). The positions of the pressure plate 21, return lever 22, and separation roller 241 are detected by ASF sensors 29 (unshown). Further, the return lever 22 for returning the sheets P to their standby positions is pivotably attached to the base 20, and is kept pressured by return lever springs 221 (unshown) in the direction in which the return level 22 is released. The return lever 22 is pivoted by a control cam 25 (unshown) when the sheets P need to be returned to their standby positions.

When the recording apparatus is on the normal standby, the pressure plate 21 is kept away from the feed roller 28 by the pressure plate cam 214 (unshown), and the separation roller 241 is kept away from the feed roller 28 by the control cam 25 (unshown). As for the return lever 22, it is kept in the position into Which it is pivoted to return the sheets P to their standby positions, and in which it blocks the entrance to the sheet conveyance path to prevent the sheets P from entering the sheet conveyance path. As the feeding of the sheets P begins when the recording apparatus is in the above described condition (on the normal standby), first, the separation roller 241 is placed in contact with the feed roller 28 by the driving force from the motor. Then, the return lever 22 is moved to the sheet feeding position, and the pressure plate 21 is pressed against the feed roller 28. With the recording apparatus being in this state, the actual feeding of the sheets P into the main assembly of the recording apparatus begins.

The number by which the sheets P are picked up by the feed roller 28 is controlled by a pre-separation portion with which the base 20 is provided, so that only a predetermined number of sheets P are sent to the nip between the feed roller 28 and separation roller 241, in which the sheets P are separated, that is, only the top sheet P is fed into the main assembly of the recording apparatus. As the fed sheet P reaches the nip between a sheet conveyance roller 36 and a pinch roller 37, the pressure plate 21 is released by the pressure plate cam 214 (unshown), and the separation roller 241 is released by the control cam 25 (unshown). The return lever 22 is allowed by the control cam 25 (unshown) to return to the standby position while pushing the unfed sheets P back into their standby positions in the sheet feeder tray 26. In other words, the sheets P, which were sent to the immediate adjacencies of the nip between the feed roller 28 and separation roller 241, but, were not actually fed into the main assembly, are returned to their standby positions in the tray 26.

[Sheet Conveying Portion]

The sheet conveying portion 3 (which hereinafter may sometime be referred to simply as conveyance portion) is attached to the central member 11 of the chassis of the recording apparatus 1, which correspond in position to the recording portion. The central member 11 of the chassis is a rigid member made up of multiple angled metallic members. The conveyance portion 3 has a sheet conveyance roller 36 which conveys the sheets P, and a PE (paper end) sensor 3 (unshown). The conveyance roller 36 is made up of, for example, a metallic shaft, and a layer of minuscule ceramic particles coated on the peripheral surface of the metallic shaft. It is attached to the central member 11 of the chassis by being supported by the lengthwise ends by a pair of bearings 36, one for one, which are attached to the central member 11 of the chassis. In order to assure that the sheets P are reliably conveyed, a conveyance roller tension spring 381 (unshown) is disposed between each of the pair of bearings 38 and corresponding lengthwise end of the metallic shaft of the conveyance roller 36 so that the conveyance roller 36 is kept under a predetermined amount of load by the resiliency of the conveyance roller tension springs 381.

The sheet conveying portion 3 is provided with multiple pinch rollers 37, which are disposed in contact with the peripheral surface of the conveyance roller 36, and are rotated by the rotation of the conveyance roller 36. The pinch rollers 37 are held by a pinch roller holder 30. The force for conveying the sheet P is transmitted to the sheet P by pressing the pinch rollers 37 by the resiliency of pinch roller springs 31 against the conveyance roller 36 with the presence of the sheet P between the pinch rollers 37 and conveyance roller 36. The pinch roller holder 30 is pivotally attached by its pivotal axles to the central member 11 of the chassis, with the presence of a bearing between each pivotal axle and the central member 11 of the chassis. The sheet conveyance portion 3 is also provided with a guide flapper 33, which are located at the entrance of the sheet conveyance portion 3, and through which the sheets P are fed into the apparatus main assembly, and a platen 34. To the pinch roller holder 30, a sensor lever 321 of the paper end (PE) sensor 32 for detecting the leading and trailing ends of the sheet P is pivotally attached. The platen 34 is attached to the central member 11 of the chassis. The guide flapper 33 is pivotally supported so that its pivotal axis coincides with those of the bearing portions 331 (unshown) of the conveyance roller 36. It is appropriately positioned by coming in contact with a part of the central member 11 of the chassis.

With the sheet conveying portion 3 being structured as described above, after being sent from the sheet feeding portion to the sheet conveying portion 3, each sheet P is sent to the nip (LF nip) between the conveyance roller 36 and pinch rollers 37 while being guided by the pinch roller holder 30 and guide flapper 33. While the sheet P is conveyed to the LF nip, the leading end of the sheet P is detected by the sensor lever 321, whereby the point on the sheet P, at which recording is to be started in the recording portion, is calculated. As for the means for conveying the sheet P along the top surface of the platen 34, a pair of sheet conveyance rollers are rotationally driven by a sheet conveyance motor 35. The top surface of the platen 34 is provided with multiple ribs. The apparent surface (plane) which coincides with the tops of these ribs constitutes the surface along which the sheet P is conveyed. Not only do these ribs control the gap between the recording head 7 and sheet P, but also, minimize, in coordination with the sheet discharging portion, the waving of the recording sheet P. As for the driving of the conveyance roller 36, the rotational force of the conveyance motor 35, which is a DC motor, is transmitted through a timing belt 351 to a pulley 361 attached to the shaft of the conveyance roller 36.

The conveyance roller 36 is provided with a code wheel 362, which is attached to the shaft of the conveyance roller 36 to detect the distance by which the sheet P has been conveyed by the conveyance roller 36. The code wheel 362 is provided with markings positioned at a pitch in the range of 501 lpi-300 lpi. Whereas, to the central member 11 of the chassis, an encoder sensor 363 for reading the makings of the code wheel 362 is attached. The recording head 7 for recording an image according to image formation data is disposed on the downstream side of the conveyance roller 36 in terms of the sheet conveyance direction. The recording head 7 of the recording apparatus in this embodiment is an ink jet recording head to which multiple ink containers, different in the color of the inks they use, are removably attachable. The recording head 7 is provided with heaters or the like, which are disposed inward of the ejection orifices, one for one, to heat the ink in the ejection orifices. As for the recording method of the recording head 7, the ink in the ejection orifice selected according to the image formation data is heated by the above-mentioned heaters or the like to cause the ink to boil in the so-called film boiling fashion, that is, in the manner of generating bubbles in the ink, so that the ink is ejected from the selected ejection orifices of the recording head by the changes in the pressure resulting from the growth or collapse of the bubbles, and forms an image on the sheet P as a recording medium as the ink lands on the sheet P.

[Carriage Portion]

The carriage portion 5 is provided with a carriage 50 on which the recording head 7 is mounted, and which is reciprocally movable in the primary scan direction, that is, the direction perpendicular to the sheet conveyance direction. The carriage 50 is movably supported by a guide shaft 52 so that it can be guided by the guide shaft 52. The guide shaft 52 is disposed so that it extends in the direction roughly perpendicular to the direction in which the sheet P is conveyed. Further, the carriage 50 is movably supported also by a guide rail 111, which is parallel to the guide shaft 52 and supports the rear portion of the carriage 50 in a manner to allow the carriage 50 to slide thereon. With the provision of this structural arrangement, the carriage 50 is kept in a predetermined attitude so that a predetermined amount of gap will be maintained between the recording head 7 and sheet P. The guide shaft 52 is attached to the central member 11 of the chassis. The guide rail 111 is an integrally formed part of the central member 11 of the chassis.

The carriage 50 is driven through a timing belt 541 by a carriage motor 54 attached to the central member 11 of the chassis. The timing belt 541 is suspended so that it is given a predetermined amount of tension by an idler pulley 542. The timing belt 541 is connected to the carriage 50 with the interposition of a damper formed of rubber or the like, which is for minimizing the amount by which the vibrations from the carriage motor 54, etc., are transmitted to the carriage 50, in order to prevent the formation of defective images for which the vibrations from the carriage 50, etc., are responsible. Disposed in parallel to the timing belt 541 is a code strip 561, which is provided with markings arranged at a pitch in the range of 150 lpi-300 lpi in order to detect the position and movements of the carriage 50. The encoder for reading these markings is located on the base plate of the carriage 50.

This carriage base plate 50 is provided with contacts for making electrical contacts between the recording head 7 and carriage 50. To the carriage 50, the flexible electrical wires, bundled in the form of a piece of tape 57, for transmitting print signals from the electrical circuit of the recording apparatus to the recording head 7 is attached. The carriage 50 is also provided with a positioning projection (or rib) for accurately positioning the recording head 7 relative to the carriage 50, and a pressing means for keeping the recording head 7 correctly held to the carriage 50. The pressing means is attached to a head setting lever 51. Rotating the head setting lever 51 causes the pressing means to press on the recording head 7.

The guide shaft 52 is provided with a pair of eccentric cams 521, which are attached to the lengthwise ends of the guide shaft 52 one for one. The guide shaft 52 is vertically movable by transmitting the driving force from an AP motor 273 to the pair of eccentric cams 521 through the combination of the main cam of the recovery mechanism portion 6 and a gear train 591. The vertical movement of the guide shaft 52 effects the vertical movement of the carriage 50, which makes it possible to set the gap between the sheet P and recording head 7 to the optimum value regardless of the thickness of the sheet P. Further, the carriage 50 is provided with an automatic registration adjustment sensor 59, which is for automatically compensating for the distance by which the ink ejected from the recording head 7 misses the theoretical landing point on the sheet P. This sensor 59 is an optical sensor of the reflection type, which is enabled to determine the optimum registration adjustment value by catching the beam of light emitted from its light emitting element and reflected by the image recorded on the sheet P in a predetermined pattern.

As for the recording operation carried out to form an image on the sheet P by the recording apparatus structured as described above, first, the sheet P is conveyed to the position at which the recording head 7 aligns with the recording line, in terms of the sheet conveyance direction, at which recording is to be started on the sheet P, and then, the carriage 50 is moved in the primary scan direction to the point of this recording line, at which recording is to be started. Then, the actual recording of an image is started from this point by moving the carriage 50 in the primary scan direction while causing the recording head 7 to eject ink by driving the recording head 7 by the image formation signals from an electrical circuit 9.

[Sheet Discharging Portion]

The sheet discharging portion 4 is made up of: a pair of sheet discharge rollers 40 and 41; rowel-like wheels 42 which are placed in contact with the sheet discharge rollers 40 and 41 in a manner to maintain a predetermined amount of contact pressure against the sheet discharge rollers 40 and 41, and which are rotated by the rotation of the sheet discharge rollers 40 and 41; a gear train for transmitting the driving force from the conveyance roller 36 to the sheet discharge rollers 40 and 41; etc. The sheet discharge rollers 40 and 41 are attached to the platen 34. The sheet discharge roller 40, which is the downstream sheet discharge roller in terms of the sheet conveyance direction, is made up of a metallic shaft, and multiple rubbery members 401 firmly fitted around the metallic shaft. The two sheet discharge rollers 40 and 41 are driven by the driving force transmitted from the conveyance roller 36 to the sheet discharge roller 40 through an idler gear. The sheet discharge roller 41, which is the upstream sheet discharge roller in terms of the sheet conveyance direction, is made up of a shaft formed of a resin, and multiple elastic members 411 formed of an elastomer and fitted around the shaft of resin. The force for driving the sheet discharge roller 41 is transmitted from the sheet discharge roller 40 through an idler gear.

Each of the rowel-like wheels 42 is an integral combination of a piece of SUS plate shaped like a rowel, and a resinous portion molded around the SUS piece. The rowel-like wheels 42 are attached to a holder 43. More specifically, the rowel-like wheels 42 are attached to the holder 43 with the use of a coil spring wound in the form of a rod, which also functions to keep the rowel-like wheels 42 pressed on the sheet discharge rollers 40 and 41. There are two types of rowel-like wheels 42: those which are positioned so that they are pressed upon the rubbery members 401 of the sheet discharge roller 40, and the elastic members 411 of the sheet discharge roller 41, one for one, essentially to generate the force for conveying the sheet P, and those which are positioned so that they face the intervals of the rubbery members 401 of the sheet discharge roller 40, and the intervals of the elastic members 411 of the sheet discharge roller 41, one for one, essentially to prevent the sheet P from floating.

Between the sheet discharge rollers 40 and 41, a sheet edge supporting portion is disposed, which keeps the lateral edge portions of the sheet P slightly raised in order to prevent the recorded image on the preceding sheet P from being damaged by being rubbed by the following sheet P. More specifically, the sheet edge supporting member is made up of members formed of resin, rollers attached to the end of the member formed of resin, sheet edge supporting springs disposed in a manner to apply a predetermined amount of upward pressure to the members form of resin, etc. Thus, while the sheet P is moved past the sheet edge supporting portion, the lateral edge portions of the sheet P is slightly raised by the predetermined amount of pressure applied thereto by the rollers. As a result, while the sheet P is moved past the sheet edge supporting portion, it is prevented from sagging, being therefore prevented from rubbing the preceding sheet P, while being conveyed by the sheet discharge rollers 40 and 41.

After the formation of an image on the sheet P in the main assembly of the recording apparatus structured as described above, the sheet P is further conveyed by being pinched by the sheet discharge roller 41 and the corresponding rowel-like wheels 42, and then, is discharged into a sheet delivery tray 46. The sheet delivery tray 46 is structured so that it can be retracted into the front cover 95 of the recording apparatus; it is to be pulled out when it is needed. In order to improve the sheet delivery tray 46 in terms of the facilitation of the accumulation of the sheets P in the sheet delivery tray 46, and to prevent the surface of the sheet P, on which an image has just been formed, from being rubbed by the sheet P immediately above or immediately below, the sheet delivery tray 46 is structured so that when it is in the open position, it inclines upward from its base portion toward its edge. Also, for the same purpose, the sheet delivery tray 46 is provided with a pair of projections (ribs), which are located at the farthest ends of the lateral edges of the sheet delivery tray 46, one for one.

[Two-Sided Printing Sheet Conveyance Route, and U-Turn Sheet Feeding Portion]

The two-sided printing sheet conveyance route for recording on the reverse side of the sheet P includes the U-turn portion of the sheet conveyance path, into which the sheet P can be fed from the U-turn sheet feeding portion 8. Next, the two-sided printing sheet conveyance route, and the U-turn sheet feeding portion 8 will be described. The sheets P are stored in a cassette 81, which is in the front portion of the recording apparatus main assembly. The cassette 81 is provided with a pressure plate 322, on which the sheets P are placed in layers, and which is for pressing the sheets P against a feed roller 821 to feed the sheets P into the apparatus main assembly while separating them one by one. To a U-turn base 84, which constitutes the main portion of the two-sided printing sheet conveyance route and the main portion of the U-turn sheet feeding portion 8, the feed roller 821 for feeding the sheets P into the apparatus main assembly, a separation roller 831 for separating the sheets P, a sheet returning lever 824 for returning the sheets P to their standby positions in the cassette 81, a controlling means for controlling the operation for pressing the pressure plate 822 against the feed roller 821 or moving it away from the feed roller 821, etc., are attached. The cassette 81 is structured so that it can be extended or shrunk to accommodate two types of sheet different in size. That is, when using the sheets P of the smaller size, or not using the cassette 31 at all, the cassette 31 can be shortened and fitted entirely within the external shell 9.

The feed roller 821 is in the form of a rod and is roughly D-shaped in cross section. It is fitted with a feed roller rubber, which is positioned close to the sheet alignment reference portion. This feed roller rubber is the actual portion that feeds the sheets P into the apparatus main assembly. The force for driving the feed roller 821 is transmitted to the feed roller 821 from a motor located along the two-sided printing sheet conveyance route, that is, a part of the sheet feeding route from the U-turn sheet feeding portion 8, through a driving force transmission gear, a planetary gear, etc. The pressure plate 822 is provided with a movable side guide 827, which is movably attached to the pressure plate 822 and correctly positions the sheets P. The pressure plate 822 is pivotable about a rotational axle by which the pressure plate 822 is attached to the cassette 81. The pressure plate 822 is pressed against the feed roller 821 by a controlling means for pressing the pressure plate 822 against the feed roller 821 or moving it away from the feed roller 821. This controlling means is made up of pressure plate springs 828 or the like disposed between the U-turn base 84 and the pressure plate 822. In order to prevent the sheets P other than the topmost sheet P from being fed along with the topmost sheet P, the portion of the surface of the pressure plate 81, which directly faces the feed roller 821, is provided with a separation sheet formed of such material as artificial leather which is substantial in co-efficient of friction. The pressure plate 822 is structured so that it can be placed in contact with, or separated from, the feed roller 821 by a pressure plate cam.

Further, the U-turn base 84 is provided with a separation roller 831 for separating the sheets P one by one. This separation roller 831 is rotatably attached to a separation roller holder with the use of an axle, and the separation roller holder is pivotable about the axes with which the separation base is provided. This separation roller holder is kept pressured toward the feed roller 821 by separation roller springs. The separation roller 831 is provided with a spring clutch structured so that the separation roller 831 is allowed to rotate only when the amount of the load to which the separation roller 831 is subjected is greater than a predetermined value. The separation roller 831 is placed in contact with, or separated from, the feed roller 821 by the combination of a separation roller release shaft and a control cam. The positions of the pressure plate 822, sheet returning lever 824, and separation roller 831 are detected by U-turn sensors.

The sheet returning lever 824 (which hereinafter will be referred to simply as return lever) is attached to the U-turn base 84, and is kept pressured in the direction to be released. In order to return the sheets P, the return lever 824 is pivoted by a control cam. When the recording apparatus is kept on the normal standby, the pressure plate 822 has been released by the pressure plate cam, the separation roller 831 has been released by the control cam, and the return lever 824 has returned the sheets P to their standby positions in the cassette 81. The return lever 824 is disposed so that it blocks the outlet of the cassette 81 to prevent the sheets P in the cassette 81 from shifting. As the recording apparatus on standby is activated for image formation, the feeding of the sheets P begins. First, the separation roller 831 is placed in contact with the feed roller 821 by the driving force from the motor. Then, the return lever 824 is released, and the pressure plate 822 is made to pivot toward the feed roller 821 to place the topmost sheet P in contact with the feed roller 821. The actual feeding of the sheets P is started when the recording apparatus is in this state.

The movement of the sheets P is regulated by a preliminary regulating means 838 with which the separation base 83 is provided, so that only a few of the sheets P at the top are sent to the nip between the feed roller 821 and separation roller 831. After being sent to the nip, the sheets P are separated in the nip, so that only the topmost sheet P is fed (conveyed) into the apparatus main assembly. Then, as soon as the single sheet P, or the topmost sheet P, which has been separated from the rest of the sheets P in the cassette 81 and has been fed into the main assembly, reaches the gap between a first U-turn roller 86 and a first U-turn pinch roller 861, the pressure plate 822 is released by the pressure plate cam, and the separation roller 831 is released by the control cam. As for the return lever 824, it is allowed to return by the control cam to the position in which the return level was when the sheets P were placed in layers in the cassette 81. As the return lever 824 is returned, the few of the sheets P, except for the topmost one, which had reached the nip between the feed roller 821 and separation roller 831, are returned to their standby positions in the cassette 81.

On the downstream side of the U-turn sheet feeding portion 8, two pairs of sheet conveyance rollers, that is, the combination of the first U-turn roller 86 and first U-turn pinch roller 861 and the combination of a second U-turn roller 87 and a second U-turn pinch roller 871, are disposed. These U-turn rollers 86 and 87 are made up of a metallic shaft (core), and four to six narrow elastic rollers fitted around the metallic shaft with the provision of predetermined intervals among them. These narrow elastic rollers are formed of EPDM, the hardness of which is in the range of 40 to 80 degrees. The pinch rollers 861 and 871 for pressing the sheet P on the U-turn rollers 86 and 87, respectively, are disposed so that their positions correspond to those of the abovementioned narrow elastic rollers of the U-turn rollers 86 and 87, one for one. The pinch rollers 861 and 871 are kept pressed upon the U-turn rollers 86 and 87 (intermediate rollers), respectively, by being fitted around a spring-loaded shaft. The U-turn sheet conveyance portion 8 is provided with an inner guide 881 and an outer guide 882, which provide the inward and outward surfaces of the U-turn portion of the U-turn sheet feeding portion (U-turn portion of two-sided printing sheet conveyance route).

The portion of the sheet conveyance path, at which the sheet conveyance route from the sheet feeding portion 2 (ASF) and the sheet conveyance route from the U-turn sheet feeding portion 8 merge, is provided with a flapper 883 for switching the sheet conveyance route, so that the sheet P can be smoothly moved into the selected route of the sheet conveyance path. More specifically, as the sheet P, which has just been fed from the sheet feeding portion 2 or the U-turn sheet feeding portion 8, reaches the conveyance roller 36, first, the leading end of the sheet P comes into contact with the nip between the conveyance roller 36 and pinch rollers 37, which have been kept stationary. As a result, not only is the sheet P corrected in attitude if it was askew, but also, it is registered. Then, the sheet P is conveyed by the conveyance roller 36. Then, as it is conveyed through the nip between the conveyance roller 36 and pinch rollers 37, recording is made on the sheet P by the recording head 7.

When it is necessary to record on the reverse side of the recorded sheet P, the recorded sheet P is conveyed backward so that it will be re-fed into the apparatus main assembly, starting from the edge of the recorded sheet P, which was the trailing edge while recording was made on the front side of the sheet P, through the gap between the conveyance roller 36 and pinch rollers 37. This conveyance of the sheet P in the backward direction is effected by the reversal rotation of the sheet discharge rollers 40 and 41. During this conveyance of the sheet P in the backward direction, the pinch rollers 37 have been raised, being therefore kept separated from the conveyance roller 36, by a mechanism 884 for raising or lowering the pinch rollers 37. In other words, the sheet P is conveyed back into the main assembly through the gap between the pinch rollers 37 and conveyance roller 36, and therefore, it is smoothly conveyed. Then, the sheet P is guided into the two-sided printing sheet conveyance route by a sheet conveyance route switching flapper 833. After being guided into the two-side printing sheet conveyance route, the sheet P is pinched by the combination of the two-sided printing sheet conveyance route roller 891 and two-sided printing sheet conveyance route pinch roller 892, being thereby conveyed further along the two-sided printing sheet conveyance route.

As the sheet P is further conveyed past the conveyance rollers 891 and 892 through the two-sided printing sheet conveyance route, it is guided by a guiding member 821 (flapper), etc., set in the position in which it blocks the outlet of the cassette 81, through which the sheets P in the cassette 81 is sent into the U-turn portion of the sheet conveyance route, through which the sheet P are fed from the U-turn sheet feeding portion 8, that is, the U-turn portion of the two-sided printing sheet conveyance route, and also, in which it provides a predetermined amount of gap between itself and the feed roller 821 to allow the sheet P to enter the U-turn portion of the two-sided printing sheet conveyance route. As the sheet P is conveyed by a predetermined distance through the two-sided printing sheet conveyance route for recording an image on the reverse side of the sheet P, it reaches the abovementioned U-turn rollers 86 and 87. In other words, the upstream portion of the two-sided printing sheet conveyance route, in terms of the sheet conveyance direction, merges with the U-turn portion of the aforementioned U-turn sheet feeding route. Thus, once the recorded sheet P reaches the U-turn rollers 86 and 87, the conveyance of the recorded sheet P thereafter is the same in structural arrangement and operation as the conveyance of the sheet P after the arrival of the sheet P at the U-turn rollers 86 and 87 (intermediate rollers) when the sheet P is fed from the U-turn sheet feeding portion 8.

[Recovery Mechanism Portion]

The recovery mechanism portion 6 with which the ink jet recording apparatus in this embodiment is provided is provided with a pump 60 for suctioning out ink or the like from the ejection orifices of the recording head 7, a cap 61 for preventing the ink and the like from drying up in the adjacencies of the openings of the ejection orifices of the recording head 7, a wiper for wiping clean the adjacencies of the openings of the ejection orifices of the recording head 7, etc. In this embodiment, the primary force for driving the recovery mechanism portion 6 is transmitted from the previously mentioned AP motor 273 as the mechanical power source for driving the sheet feeding portion 2. More specifically, the recovery mechanism portion 6 is provided with a one-way clutch so that the rotation of the AP motor in one direction drives the pump 60, whereas the rotation of the AP motor in the other direction causes the wiper 62 to wipe, and also, the cap 61 to cover the ejection orifices or separate therefrom.

As for the type of the pump 60, a so-called tube pump can be used. A tube pump is made up of a pair of tubes 67 and pumping rollers, and is structured so that negative pressure is generated as the pair of tubes 67 are stroked by the pumping rollers. The cap 61 and pump 60 are connected with the interposition of a valve. Such ink that has adhered to the adjacencies of the openings of the ejection orifices, and the waste ink, that is, the portion of the body of the ink in each of the ejection orifices, which contains air bubbles or the like, can be suctioned away, along with a certain amount of the good ink in each of the ejection orifices, by activating the pump 60 with the cap 61 being placed airtightly in contact with the recording head 7 (with recording head capped). The cap 61 is provided with an absorbent member 611, which is fitted inside the cap 61 to rid the surface of the recording head 7 having the openings of the ejection orifices, of the ink remaining thereon after the suction. Further, in order to prevent the problem that ink remains in the absorbent member 611 of the cap 61 and solidifies therein, the pump 60 is activated with the cap separated from the recording head 7 to suction away the ink remaining in the cap 61. The waste ink, that is, the ink having been suctioned away by the pump 60 is absorbed into a waste ink absorbing member located in the bottom case 99, and retained therein.

The operational sequence which comprises the operation for moving the wiper 62, the operation for capping or uncapping the recording head 7, etc., is controlled by a main cam, which is an integral combination of multiple cams. In other words, as the specific portions of the main cam act on the corresponding cams or arms, various operations are carried out with predetermined timing. The position of each of the specific portions of the main cam can be detected by position sensors such as a photo-interrupter. The surface of the recording head 7, which has the openings of the ejection orifices, is wiped by the wiper 62 by placing the wiper 62 in contact with the surface while the cap 61 is away from the surface. In this embodiment, the recovery mechanism portion 6 is provided with two wipers 62: the one which wipes the adjacencies of the openings of the ejection orifices and the other which wipes the entirety of the surface having the openings of the ejection orifices, inclusive of the adjacencies of the openings of the ejection orifices. The ink and the like contaminants having adhered to each wiper 62 are removed (wipers are cleaned) by a wiper cleaner 66, with which the wipers 62 comes into contact as they reach the rearmost ends of their wiping ranges.

The transmission and control of the driving force to the valve between the cap 61 and pump 60 to open or close the valve is carried out by the sheet discharge roller 40. The recovery mechanism portion 6 is structured to make it possible to selectively open or close one or more of the valves so that all the inks, which are different in color, can be suctioned at the same time, or each ink can be selectively and independently suctioned, as necessary. The position of each valve is detected by a valve position sensor.

[External Shell]

The above described various portions and mechanisms are attached to the central member 11 of the chassis, and constitute the mechanical portion of the recording apparatus. The external shell 9 is attached to the central member 11 of the chassis in a manner of wrapping this mechanical portion. The external shell 9 comprises a bottom case 99, a top case 98, an accessory cover 97, a connector cover 96, a front cover 95, and a pair of side covers 93. To the front cover 95, the sheet delivery tray 46 is retractably attached so that when the tray 46 is not required, it can be retracted into the front cover 95 to cover the opening of the sheet outlet. Whether the front cover 95 is open or closed can be detected by an unshown sensor. To the top case 98, an access cover 97 is pivotably attached. A part of the top case 98 is provided with an opening, through which the recording head 7 and ink containers 71 can be replaced.

Also to the top case 98, a door switch lever for detecting the opening and closing of the access cover 97, an LED guide for transmitting and displaying the light from an LED, and key switches which act on the SWs of the control circuit, are attached. Further, to the top case 98, the sheet feeder tray 26 is attached, which is pivotable, and also, can be extended or shortened. When the usage of the sheet feeder tray 26 is not required, the sheet feeder tray 26 can be shortened and pivoted into the top case 98 to cover the sheet feeding portion. The top and bottom cases 98 and 99 are attached to each other with the use of elastic clips. The top and bottom cases 98 and 99 are shaped so that as they are attached to each other, they leave a hole, between their predetermined portions, for electrical connectors. This hole is covered with a connector cover 96. The side covers 93 are attached in a manner of covering the lateral portions of the top and bottom cases 98 and 99 from the left- and right-hand sides of the recording apparatus.

Next, a multiple choice sheet feeding unit 10, which characterizes this embodiment of the present invention, will be described. The multiple choice sheet feeding unit 10 is an integral combination of the sheet feeding portions 2 and U-turn sheet feeding portion 8. As described above, to the ASF base 20 of the sheet feeding portion 2, the components for feeding the sheets P of recording medium, while separating them one by one as the sheets P are fed into the recording apparatus main assembly from the ASF, are attached, and to the U-turn base 84 of the U-turn sheet feeding portion 8, the components for feeding the sheets P of recording medium, while separating them one by one when the sheets P are fed into the main assembly from the U-turn sheet feeding portion 8, are attached. In other words, in this embodiment, the recording apparatus is provided with the U-turn sheet feeding portion 8 in addition to the sheet feeding portion 2, and is structured so that the sheets P of recording medium can be delivered to the recording portion of the sheet conveyance path from either of the two recording medium storage portions (pressure plates 21 and 822) through different routes. In other words, the recording apparatus is provided with multiple (two) sheet conveyance routes which lead to the common sheet conveyance portion.

The bases 20 and 84, to which the above described components have been attached, are fixed to the central member 11 of the chassis in a manner of sandwiching the bases 20 and 84 with the right- and left-hand members 112 and 113 of the chassis of the recording apparatus, making up the multiple choice sheet feeding unit 10. The right- and left-hand members 112 and 113 of the chassis are very rigid members formed of metallic plate or the like material. The right- and left-hand members 112 and 113 of the chassis may be simply called lateral chassis members.

Also to the central member 11 of the chassis of the recording apparatus, the sheet conveyance unit comprising the conveyance roller 36, pinch rollers 37, and platen 34, and the recording unit comprising the carriage 50 and recording head 7, are firmly and integrally attached, making up the recording unit (conveying-recording unit), as described above.

To sum up, the recording apparatus in this embodiment of the present invention is provided with: the multiple (two) sheet feeding routes through which sheets P of recording medium are fed from the recording medium storage portions 21 and 822, respectively, into the main assembly of the recording apparatus, and conveyed further to the recording portion; carriage 50 on which the recording head 7 is mounted, and which is reciprocally movable in the recording portion, while holding the recording head 7; platen 34 which corresponds in position to the moving range of the carriage 50 and supports recording medium; and sheet conveyance roller 36 disposed on the upstream side of the carriage 50 in terms of the sheet conveyance direction to convey recording medium. It also is provided with: the recording unit comprising the carriage, conveyance roller, and platen, which are firmly attached to the central member 11 of the chassis; and multiple choice sheet feeding unit 10 comprising the various components which provide the recording apparatus with the multiple (two) sheet conveyance routes extending from the multiple (two) sheet feeding portions to the conveyance roller 36, and are supported by the lateral members 112 and 113 of the chassis from the right- and left-hand sides, respectively, of the recording medium in the apparatus. The recording unit and multiple choice sheet feeding unit 10 are integrated by being fastened to the central member 11 of the chassis of the recording apparatus. The lateral members 112 and 113 of the chassis are fastened to the central member 11 of the chassis, making up the rear portion of the chassis of the recording apparatus. The abovementioned sheet conveyance path comprises the multiple (two) sheet conveyance routes: one that leads from the recording medium storage portion 21 of the sheet feeding portion 2 to the abovementioned sheet conveyance unit, and the other that leads from the recording medium storage portion 822 of the U-turn sheet feeding portion 8 to the abovementioned sheet conveyance unit.

Figure 6:
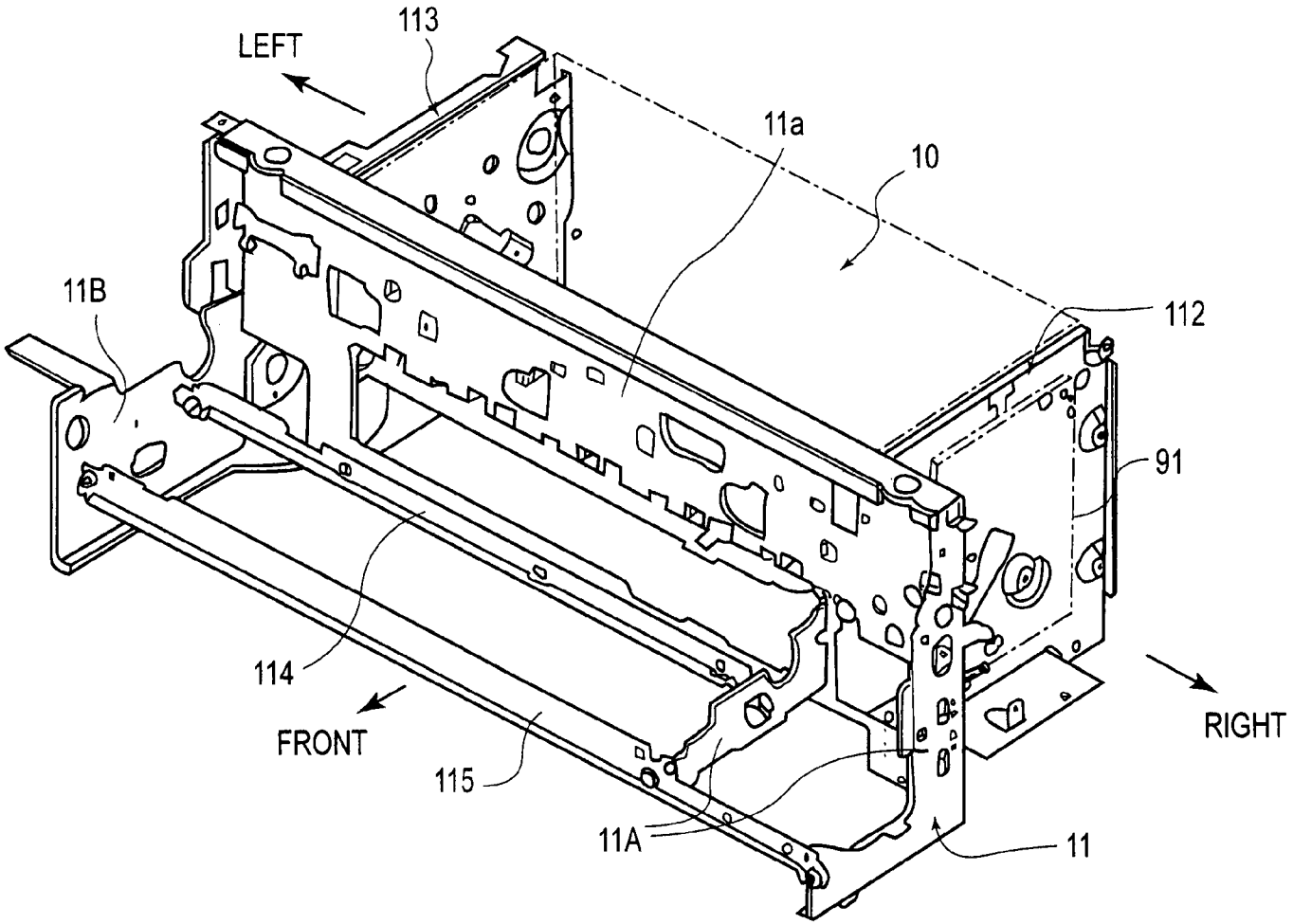
FIG. 6 is a perspective view of the chassis of the recording apparatus, as seen from the right front side, showing the general structure thereof.
Figure 7:
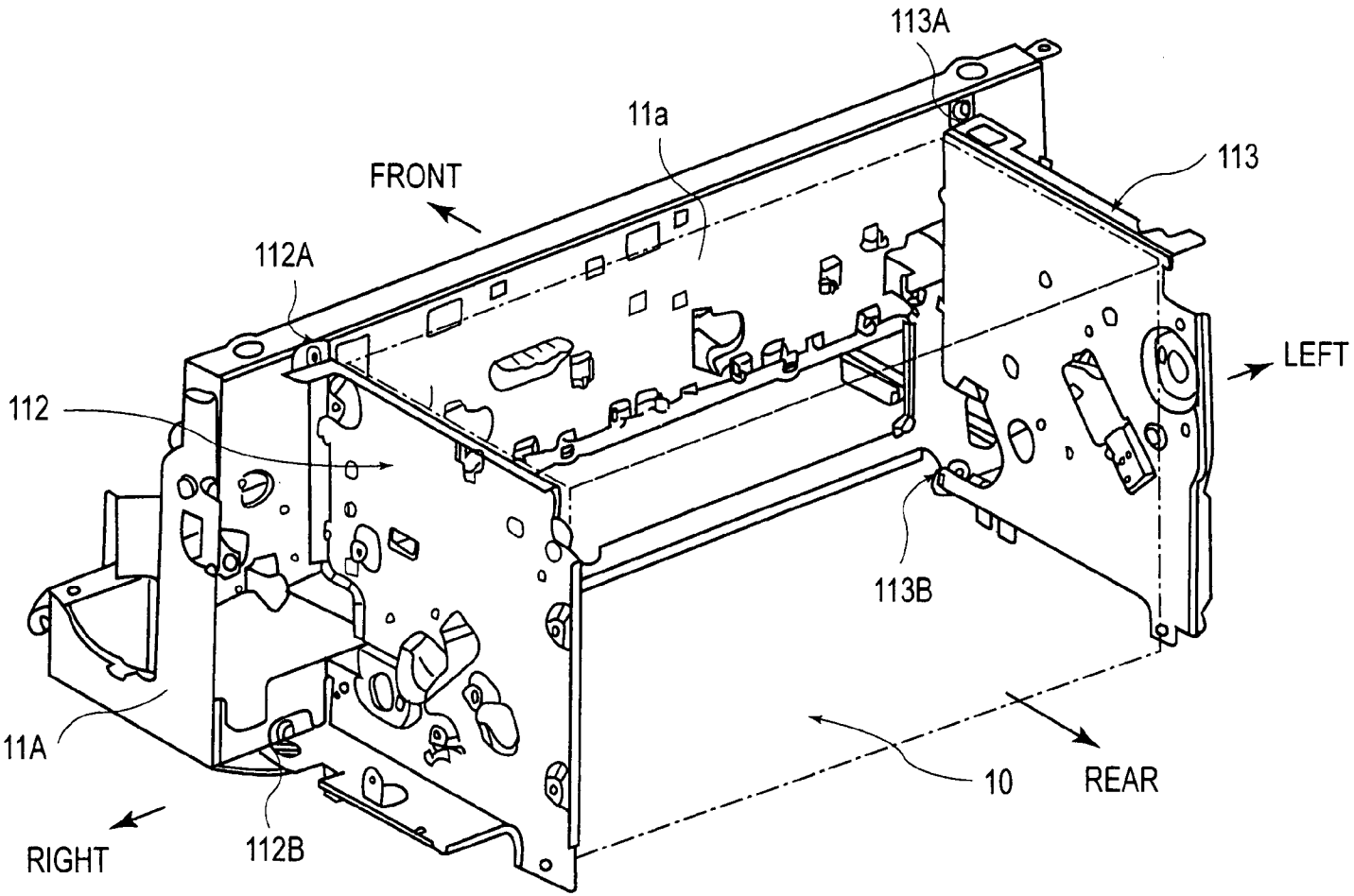
FIG. 7 is a perspective view of the chassis of the recording apparatus, as seen from the right rear side, showing the general structure thereof.
Figure 8:
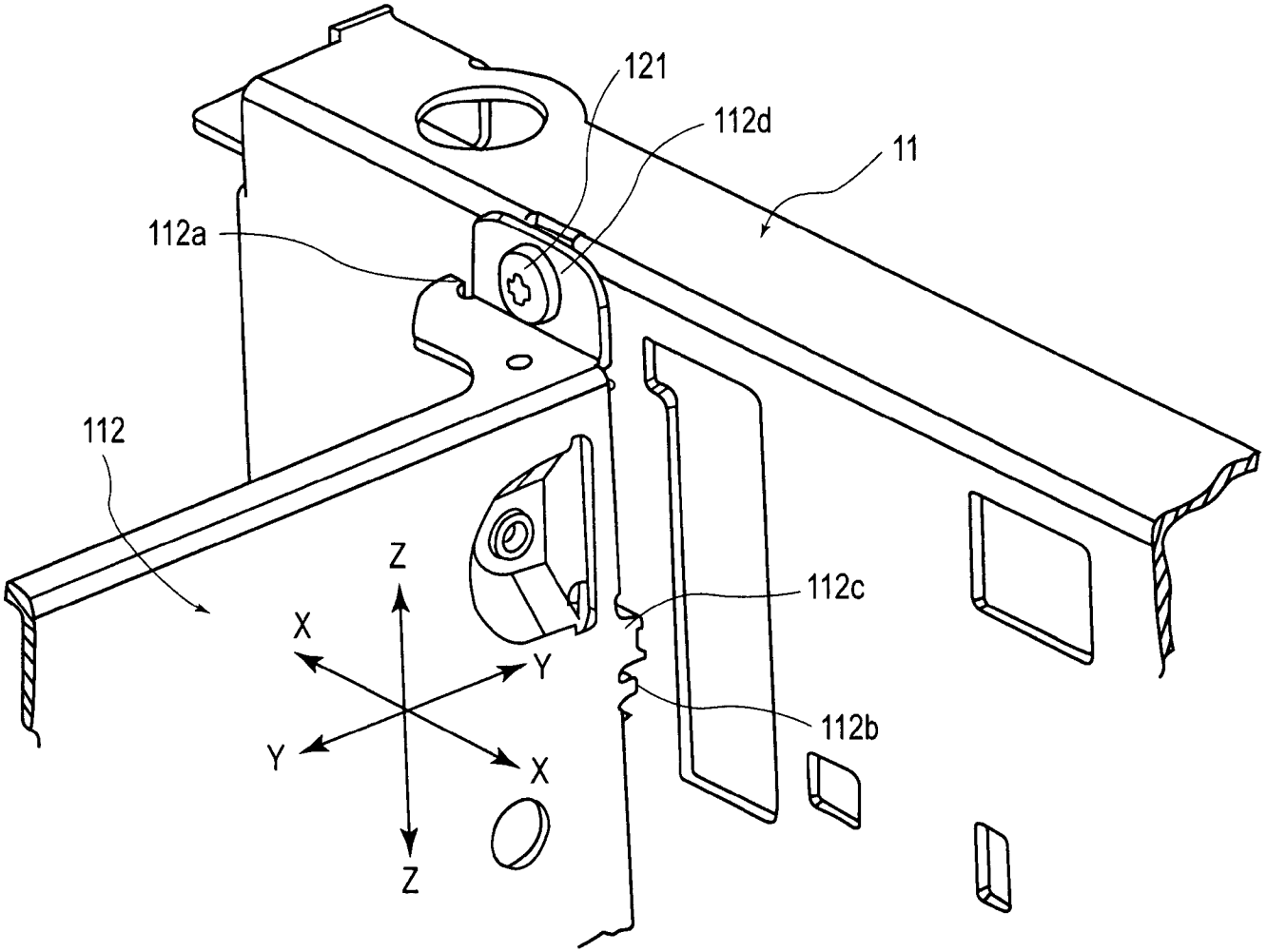
FIG. 8 is an exploded view of the joint portions between the recording portion member of the chassis of the recording apparatus and the right-hand lateral member of the chassis, showing the structural arrangement for fastening the lateral member of the chassis to the recording portion member of the chassis.

FIG. 6 is a perspective view of the chassis of the recording apparatus in accordance with the present invention, as seen from the right front side, showing the general structure thereof. FIG. 7 is a perspective view of the chassis of the recording apparatus in accordance with the present invention, as seen from the right rear side, showing the general structure thereof. FIG. 8 is an exploded perspective view of one of the joint portions, and its adjacencies, of the chassis of the recording apparatus in accordance with the present invention, between the central member 11 and one of the lateral members, showing the structures thereof.

Referring to FIGS. 6-8, the multiple choice sheet feeding unit 10 comprising the various components which provide the recording apparatus with the multiple (two) sheet conveyance routes extending from the multiple (two) recording medium storage portions 21 and 822 to the conveyance roller 36, respectively, and are supported by the lateral members 112 and 113 of the chassis from the right- and left-hand sides of the recording apparatus, and the recording unit comprising the carriage 50, conveyance roller 36, and platen 34, which are fastened to the central member 11 of the chassis by fastening the lateral members 112 and 113 of the chassis to the central member 11 of the chassis.

The right- and left-hand members 112 and 113 of the chassis are fastened to the rear side of the wall-like flat portion 11*a* of the central member 11 of the chassis, which extends from one lateral side of the recording apparatus to the other. Next, referring to FIG. 7, the right-hand member 112 of the chassis is fastened to the central member 11 of the chassis by the two portions, that is, the top and bottom portions 112A and 112B, and also, the left-hand member 113 of the chassis is fastened to the central member 11 of the chassis by two portions, that is, the top and bottom portions 113A and 113B. These portions 112A, 112B, 113A, and 113B by which the right- and left-hand members 112 and 113 of the chassis are fastened to the central member 11 of the chassis are virtually identical in structure. Therefore, the method for fastening the lateral members 112 and 113 of the chassis to the central member 11 of the chassis, that is, the method for assembling the multiple choice sheet feeding unit 10, will be described with reference to FIG. 8, which shows the method for fastening the top portion 112A of the right-hand member 112 of the chassis to the central member 11 of the chassis.

Referring to FIG. 8, first, the projection 112*c* which projects from the edge of the main portion of the right-hand member 112 of the chassis, which will be in contact with the central member 11 of the chassis after the assembly, is fitted into the corresponding hole (one of the holes (openings)) of the central member 11 of the chassis. As a result, the right-hand member 112 of the chassis is precisely positioned relative to the central member 11 of the chassis in terms of the vertical direction (indicated by arrow mark Z in FIG. 8) as well as the side to side direction (indicated by arrow mark Y in FIG. 8). Further, two projections 112*a* and 112*b* which project from the top and bottom rear corners of the main portion of the right-hand member 112 of the chassis, are placed in contact with the rear side of the flat portion 11*a* of the central member 11 of the chassis. As a result, the right-hand member 112 is precisely positioned relative to the central member 11 of the chassis in terms of the front to back direction (indicated by arrow mark Y in FIG. 8). The right-hand member 112 is also provided with an anchoring portion 112*d*, which will be placed in parallel to the flat portion 11*a* of the central member 11 of the chassis with the presence of a minuscule gap between the anchoring portion 112*d* and flat portion 11*a* as the right-hand member 112 is precisely positioned relative to the central member 11 of the chassis as described above. Thus, with the right-hand member 112 precisely positioned relative to the central member 11 of the chassis, the anchoring portion 112*d* is fastened to the flat portion 11*a* of the central member 11 of the chassis with a small screw 121. As a result, the right-hand member 112 is firmly attached to the central member 11 of the chassis and remains precisely positioned relative to the central member 11 of the chassis.

Also, the bottom projection 112B of the right-hand member 112 of the chassis, the structure of which is similar to that shown in FIG. 8, is precisely positioned relative to the central member 11 of the chassis and fastened to the rear side of the flat portion 11*a* of the central member 11 of the chassis. In other words, the right-hand member 112 is fastened to the rear side of the flat portion 11*a* of the central member 11 of the chassis by the anchoring portions 112*d* of the top and bottom projections 112A and 112B, while remaining precisely positioned relative to the central member 11 of the chassis. Further, the left-hand member 113 of the chassis is also fastened to the rear side of the flat portion 11*a* of the central member 11 of the chassis by the top and bottom projections 113A and 113B, while remaining precisely positioned relative to the central member 11 of the chassis. With the employment of the above described structural arrangement for attaching the lateral members 112 and 113 of the chassis to the central member 11 of the chassis, it is easy to correctly position the lateral members 112 and 113 relative to the central member 11 and securely attach them to the central member 11. Further, to the outward surface of the chassis (right-hand member 112 shown in drawings) formed of metallic plate or the like, a main circuit board 91 having the control circuit of the recording apparatus is attached. This structural arrangement for attaching the main circuit board 91 is superior in terms of protecting the main circuit board 91 from noises, radiating heat from the main circuit board 91, etc. Further, it makes it possible to utilize the roughly rectangular flat portion of the chassis, as the portion to which the roughly flat circuit board 91 (main circuit board) is mounted virtually flush therewith. In other words, it makes it possible to more effectively use the internal space of the main assembly of the recording apparatus in order to reduce the main assembly in size.

Also in this embodiment, the AP motor 273 shared by the sheet feeding portion 2 and recovery mechanism portion 6 is attached to the right-hand member 112 of the chassis, and the two-sided printing sheet conveyance motor 85 (FIG. 3) used for conveying the sheet P through the two-sided printing sheet conveyance route, and also, feeding the sheet P from the U-turn sheet feeding portion, is attached to the left lateral member 113 of the chassis. With the employment of this structural arrangement, the motors 273 and 85 are very reliably fastened to the chassis of the recording apparatus while being accurately positioned relative to the chassis. Therefore, the amounts by which the driving forces from the motors 273 and 85 are lost while they transmitted to the sheet conveying/recording unit are substantially smaller, compared to the corresponding structural arrangement in accordance with the prior art. Incidentally, it is desired that the surfaces of the right and left lateral members 112 and 113 of the chassis are utilized not only as the portion to which the main circuit board 91 is attached, but also, as the portion to which motors as driving power sources, sensors for controlling the recording apparatus, etc., are attached. With such utilizations, the recording apparatus can be improved in terms of shielding the electrical components from noises, radiating heat from the electrical components, etc.

Further, the central member 11 of the chassis is provided with a pair of perpendicularly angled portions 11A and 11B, to which the components for mounting the conveyance roller 36, etc., are to be attached. In this embodiment, a member 114 of the chassis, to which the platen 34 is attached, and a front member 115 of the chassis, are fastened to these angled portions 11A and 11B by their respective lengthwise ends, with small screws or the like, as shown in FIG. 6, functioning as the staying members of the chassis. In other words, the right- and left-hand end portions, that is, the perpendicularly angled portions 11A and 11B, are connected with the member 114 of the chassis, to which the platen 34 is attached, and front member 115 of the chassis. More specifically, a structural arrangement that the lateral sections of the central member 11 of the chassis, which are for supporting the conveyance roller 36, are connected with the pair of staying members positioned on the upstream and downstream sides, one for one, of the platen 34, in terms of the sheet conveyance direction, is employed. To sum up, the chassis of the recording apparatus in this embodiment is made up of the central member 11, right- and left-hand lateral members 112 and 113, the platen supporting member 114, and front member 115.

The addition of the platen supporting member 114 and front member 115 gives the chassis of the recording apparatus a boxy shape; in a sense, it turns the chassis of the recording apparatus into the so-called box chassis, improving the chassis in rigidity. Thus, the fastening of the multiple choice sheet feeding unit 10 to this chassis, which is substantially more rigid than any of the chassis in accordance with the prior art, makes it possible to reduce the recording apparatus in the vibrations, noises, etc., making it thereby possible to eliminate the problem that images cannot be printed at a high level of accuracy because of the vibrations attributable to the lack of rigidity in the recording apparatus chassis. Also in this embodiment, the components, more specifically, the base 20 and U-turn base 84 shown in FIG. 5, which provide the sheet conveyance path of the recording apparatus, with the multiple sheet conveyance routes (ASF route and two-sided printing route), are molded in a single piece, or some of these components, which are shared by the multiple sheet conveyance routes, are molded in a single piece. Further, the various components which make up the multiple choice sheet feeding unit 10 are attached to these bases 20 and 84. Therefore, not only can the employment of the structural arrangement employed in this embodiment reduce a recording apparatus in size, but also, improve the recording apparatus in assembly efficiency and shock resistance.

Further, according to the above described structural arrangement, the base 20 of the sheet feeding portion 2 and the base 84 of the U-turn sheet feeding portion 8 are highly precisely and reliably fastened to the chassis of the recording apparatus with the use of the right- and left-hand members 112 and 113 of the chassis. Therefore, the sheet conveyance route starting from the ASF, which is primarily provided by the base 20, and the sheet conveyance route starting from the U-turn sheet feeding portion 8, which is primarily provided by the base 84, are superior in the positioning of the components thereof and the level of accuracy at which recording medium is conveyed. Further, the bases 20 and 84, which are structural components, are not deformed (twisted), or are less likely to be deformed, improving thereby the recording apparatus in terms of the reliability with which recording medium is fed and conveyed. Further, the multiple choice sheet feeding unit 10 is fastened to the member 11 of the chassis, that is, the chassis member to which the recording portion is attached, as described above. Therefore, the member 11 and lateral members 112 and 113 of the chassis give the chassis a boxy shape, and also, it is ensured that the multiple choice sheet feeding portion 10 is positioned relative to the conveyance-recording unit at a higher level of accuracy. Therefore, recording medium is corrected in attitude at a higher level of accuracy.

As will be evident from the description of this embodiment given above, the structural arrangement in this embodiment makes it easier to reduce a recording apparatus in size, and also, improve a recording apparatus in assemblage efficiency, shock resistance, reliability, and sheet conveyance performance. The present invention is particularly effective when it is applied to a recording apparatus having multiple recording medium conveyance routes, inclusive of the U-turn sheet conveyance route or the like.

Incidentally, this embodiment of the present invention was described with reference to a case in which the recording apparatus is an ink jet recording apparatus. However, not only is the present invention applicable to an ink jet recording apparatus, but also, recording apparatuses employing a recording method other than the ink jet recording method: for example, recording apparatuses employing one of the wire-dot method, thermal method, laser beam method, etc. Further, not only is the present invention applicable to a monochromatic recording apparatus, but also, a color recording apparatus which employs a single or multiple recording heads to record color images using multiple inks different in color, a gradation recording apparatus which employs a single or multiple recording heads to record images using multiple inks which are the same in color but different in density, and a recording apparatus which is a combination of one or more of the preceding recording apparatuses.

According to the above described structural arrangement, it is easy to reduce in size a recording apparatus having a sheet feeding portion for feeding recording medium inward of its main assembly from its recording medium storage portion, and also, improve a recording apparatus in assemblage efficiency, shock resistance, an reliability in sheet conveyance performance. The above described structural arrangement is particularly effective when applied to a recording apparatus having multiple recording medium conveyance routes inclusive of the U-turn portion.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 223052/2004 filed Jul. 30, 2004 which is hereby incorporated by reference.

What is claimed is:

1. A recording apparatus for effecting recording on a recording material by a recording head, said recording apparatus comprising:

a recording unit including a reciprocally movable carriage for carrying the recording head, a platen for supporting a recording material at a position opposed to said carriage, a conveyance roller, disposed upstream of said platen with respect to a moving direction of the recording material, for conveying the recording material, a recording chassis including a flat portion which extends from one lateral side of the recording chassis to the other, a right portion of said recording chassis extending from a right end of the flat portion, a left portion of said recording chassis extending from a left end of the flat portion, wherein the right portion and the left portion support said carriage, said platen, and said conveyance roller, a platen supporting member to which said platen is attached, and a front member, wherein a second right portion of said recording chassis and a second left portion of said recording chassis extend from the flat portion of the chassis toward a front side of the recording apparatus, wherein said platen supporting member and said front member are fixed to the second right portion and the second left portion by their respective lengthwise ends so that the second right portion and the second left potion are connected by said platen supporting member and said front member, and wherein said front member is disposed downstream of said platen supporting member; and a sheet feeding unit including a first feeding path for feeding the recording material from a rear side of said apparatus toward said conveyance roller, a second feeding path for reversing and feeding the recording material from below said platen toward said conveyance roller, and a side chassis supporting said first feeding path and said second feeding path at laterally opposite positions with respect to a feeding direction of the recording material, wherein said side chassis of said sheet feeding unit is fixed to the flat portion of the recording chassis.

2. An apparatus according to claim 1, wherein an electrical substrate is mounted to said side chassis.

3. An apparatus according to claim 1, wherein a motor as a driving source and a sensor for control operation are mounted on said side chassis.

4. An apparatus according to claim 1, wherein said recording chassis includes side plates for supporting said conveyance roller at respective lateral sides, and said side plates are connected with and fixed to each other by stays at upstream and downstream positions of said platen with respect to a moving direction of the recording material.

5. A recording apparatus according to claim 1, wherein the side chassis of the sheet feeding unit are fixed to a rear side of the flat portion of the recording chassis.

6. A recording apparatus according to claim 5, wherein the second right portion of the recording chassis and the second left portion of the recording chassis are formed by angling right and left portions of the chassis.

7. A recording apparatus according to claim 1, further comprising a cassette disposed under the platen for containing the recording material, wherein the recording material contained in the cassette is fed through the second feeding path.

* * * * *